US010870909B2

(12) United States Patent
Fujita et al.

(10) Patent No.: US 10,870,909 B2
(45) Date of Patent: Dec. 22, 2020

(54) HEAT TREATMENT FACILITY

(71) Applicants: DOWA THERMOTECH CO., LTD., Tokyo (JP); TOYOTA JIDOSHA KABUSHIKI KAISHA, Aichi-Ken (JP)

(72) Inventors: Takahiro Fujita, Shizuoka (JP); Masayoshi Ikeyama, Aichi-ken (JP)

(73) Assignees: DOWA THERMOTECH CO., LTD., Tokyo (JP); TOYOTA JIDOSHA KABUSHIKI KAISHA, Aichi-ken (JP)

( * ) Notice: Subject to any disclaimer, the term of this patent is extended or adjusted under 35 U.S.C. 154(b) by 123 days.

(21) Appl. No.: 16/175,069

(22) Filed: Oct. 30, 2018

(65) Prior Publication Data

US 2019/0127836 A1 May 2, 2019

(30) Foreign Application Priority Data

Oct. 31, 2017 (JP) ..... 2017-210237

(51) Int. Cl.

| | |
|---|---|
| ***F27B 5/00*** | (2006.01) |
| ***C23C 8/22*** | (2006.01) |
| ***C21D 9/00*** | (2006.01) |
| ***F27D 5/00*** | (2006.01) |
| ***C23C 8/20*** | (2006.01) |
| ***C21D 1/06*** | (2006.01) |
| *F27B 5/14* | (2006.01) |
| *C21D 1/773* | (2006.01) |

(52) U.S. Cl.

CPC ..... *C23C 8/22* (2013.01); *C21D 1/06* (2013.01); *C21D 9/0025* (2013.01); *C21D 9/0043* (2013.01); *C23C 8/20* (2013.01); *F27B 5/00* (2013.01); *F27D 5/00* (2013.01); *C21D 1/773* (2013.01); *F27B 2005/143* (2013.01); *F27D 2005/0081* (2013.01); *F27D 2005/0087* (2013.01)

(58) Field of Classification Search

CPC ..... C21D 9/0025; C21D 1/06; C23C 8/22
USPC ..... 266/274; 432/252
See application file for complete search history.

(56) References Cited

U.S. PATENT DOCUMENTS 2,537,145 A 1/1951 Lovatt et al.
4,856,022 A 8/1989 Jones
(Continued)

FOREIGN PATENT DOCUMENTS

CN 205893373 U 1/2007
CN 1303647 C 3/2007
(Continued)

OTHER PUBLICATIONS

Official Communication issued in European Patent Office (EPO) Patent Application No. 18202644.3, dated Dec. 12, 2018.
(Continued)

*Primary Examiner* — Scott R Kastler
(74) *Attorney, Agent, or Firm* — Greenblum & Bernstein, P.L.C.

(57) ABSTRACT

A heat treatment facility performing a heat treatment on a workpiece, the heat treatment facility includes: a treatment container in which the workpiece is housed; a heater which is provided in the treatment container and heats the workpiece by radiation heat at least from below the workpiece; and a plurality of support posts which are provided in the treatment container and support the workpiece.

5 Claims, 6 Drawing Sheets

(56) References Cited

U.S. PATENT DOCUMENTS

| | | | | |
|---|---|---|---|---|
| 5,224,857 | A * | 7/1993 | Schultz | F27D 1/0023 126/92 R |
| 6,033,629 | A * | 3/2000 | Friederick | F23G 5/10 110/210 |
| 6,349,108 | B1 | 2/2002 | Ashburn | |
| 7,039,303 | B2 | 5/2006 | Kimura et al. | |
| 2005/0069309 | A1 | 3/2005 | Kimura et al. | |
| 2005/0100852 | A1 | 5/2005 | Maumus et al. | |
| 2007/0069433 | A1 | 3/2007 | Jones | |
| 2014/0042678 | A1 | 2/2014 | Wilson et al. | |
| 2016/0312352 | A1 | 10/2016 | Katsumata et al. | |
| 2017/0159150 | A1 | 6/2017 | Kuwayama | |

FOREIGN PATENT DOCUMENTS

| | | | |
|---|---|---|---|
| EP | 0702503 | | 3/1996 |
| EP | 0702503 | A2 | 3/1996 |
| JP | 2005-129501 | | 5/2005 |
| JP | 2006/112770 | | 4/2006 |
| JP | 2009/52838 | | 3/2009 |
| JP | 2013019029 | A | 1/2013 |

OTHER PUBLICATIONS

European Office Action, European Patent Office, Application, No. 18202644.3, dated Jan. 3, 2020 (in English).

Japanese Office Action, Japanese Patent Office, Application No. 2017-210237, dated Apr. 8, 2020.

Chinese Office Action, Chinese Patent Office, Application No. 201811288379.5, dated May 29, 2020.

* cited by examiner

HEAT TREATMENT FACILITY

BACKGROUND OF THE INVENTION

1. Field of the Invention

The present invention relates to a heat treatment facility for performing a heat treatment on a workpiece such as an automobile part, a machine part or the like.

2. Description of the Related Art

As furnaces performing a carburizing treatment being one example of the heat treatment, there are vacuum carburizing furnaces disclosed in Japanese Laid-open Patent Publication No. 2006-112770 (hereinafter, "Patent Document 1") and Japanese Laid-open Patent Publication No. 2009-52838 (hereinafter, "Patent Document 2"). The vacuum carburizing furnace in Patent Document 1 has such a structure that a tray or a basket is mounted on a furnace bed attached to a furnace casing, and a workpiece being an object to be treated is mounted and supported thereon. Besides, the vacuum carburizing furnace in Patent Document 2 has such a structure that a frame is attached to and in contact with a furnace shell and a workpiece is mounted and supported on the frame. In the conventional furnaces, a heating treatment, a carburizing treatment and so on are performed in a state where the workpiece and a jig composed of a steel material are supported in the above manner.

SUMMARY OF THE INVENTION

In performing the heat treatment on the workpiece, the workpiece is heated to a desired heat treatment temperature after the workpiece is transferred into the furnace. However, in the conventional furnaces, there occurs a temperature variation in the workpiece during a temperature increase of the workpiece or during a heat treatment thereafter. The temperature variation during the temperature increase of the workpiece or during the heat treatment leads to a quality variation after the heat treatment, and therefore it is preferable to decrease the temperature variation in the workpiece in a heat treatment process. To uniformly heat the workpiece, there are conceivable methods such as a gradual temperature increase of gradually increasing the temperature of the workpiece by gradually increasing the output of the heater and a step temperature increase of securing a soaking time period of the workpiece by increasing stepwise the output of the heater. Further, there is a conceivable method of achieving the soaking of the workpiece utilizing convection heat transfer by a nitrogen gas and a stirring fan. However, in any method, the running cost increases, resulting in an increase in cost as the whole heat treatment. Accordingly, it is desired to suppress the temperature variation in the workpiece by another method.

The present invention has been made in consideration of the above circumstances, and its object is to suppress temperature variation in a workpiece in a heat treatment.

Since the member supporting the workpiece generally needs to support the weight of the workpiece and the jig, a rail-shaped support member is used for the purposes of increasing the contact area with the workpiece and the jig and of suppressing the deformation of the jig on which the workpiece is mounted. On the other hand, when the present inventors have examined the cause of the temperature variation in the workpiece in the heat treatment, it has been turned out that the heat radiation of the heater contributing to the temperature increase on the lower surface side of the workpiece is intercepted by the rail-shaped support member and there occurs temperature variation due to the difference in input heat quantity at each portion of the workpiece accompanying the interception. The present inventors have found out a new workpiece supporting method different from the workpiece supporting method by the rail-shaped support member that is a conventional common general technical knowledge, on the basis of the finding.

Specifically, an aspect of the present invention solving the above problem is a heat treatment facility performing a heat treatment on a workpiece, the heat treatment facility including: a treatment container in which the workpiece is housed; a heater which is provided in the treatment container and heats the workpiece by radiation heat at least from below the workpiece; and a plurality of support posts which are provided in the treatment container and support the workpiece.

The heat treatment facility according to the present invention supports the workpiece by the support posts composed of pillar members, thus making the interception of heat radiation of the heater with respect to the workpiece less than before. Thus, the workpiece can be more uniformly heated.

According to the present invention, it is possible to suppress temperature variation in a workpiece in a heat treatment.

MODES FOR CARRYING OUT INVENTION

Figure 1:
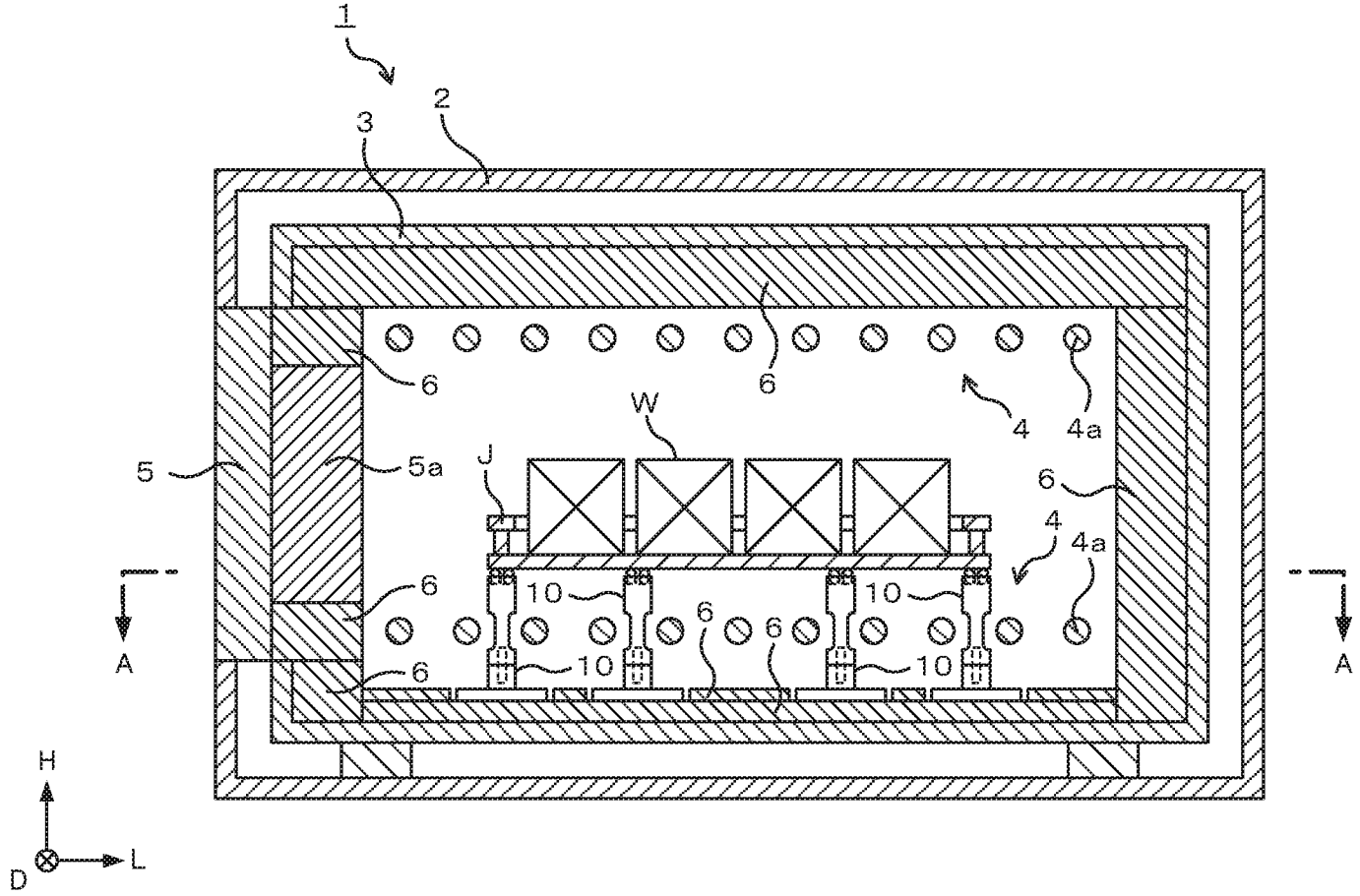
FIG. 1 is a longitudinal sectional view illustrating a schematic configuration of a vacuum carburizing furnace according to an embodiment of the present invention.

Hereinafter, an embodiment according to the present invention will be described referring to the drawings. Note that in this description and the drawings, the same codes are given to components having substantially the same functional configurations to omit duplicated explanation.

In this embodiment, a vacuum carburizing furnace being one kind of a heat treatment facility will be described as an example. As illustrated in FIG. 1, a vacuum carburizing furnace 1 according to this embodiment includes a vacuum chamber 2, a treatment container 3 in which a workpiece W is housed, heaters 4 which heat the workpiece W, and support posts 10 which directly support the workpiece W via a jig J in a tray shape.

In side walls of the vacuum chamber 2 and the treatment container 3, an opening part is formed for transferring in and transferring out the jig J on which the workpiece is mounted, and a door 5 of an opening/closing type for blocking the opening part is provided at the vacuum chamber 2. On the surface on the treatment container side of the door 5, a door heat insulating material 5*a* is provided. The treatment container 3 is hermetically closed by the door 5 being closed and the door heat insulating material 5*a* coming into contact with a heat insulating material 6 covering the entire inner surface of the treatment container 3.

Figure 2:
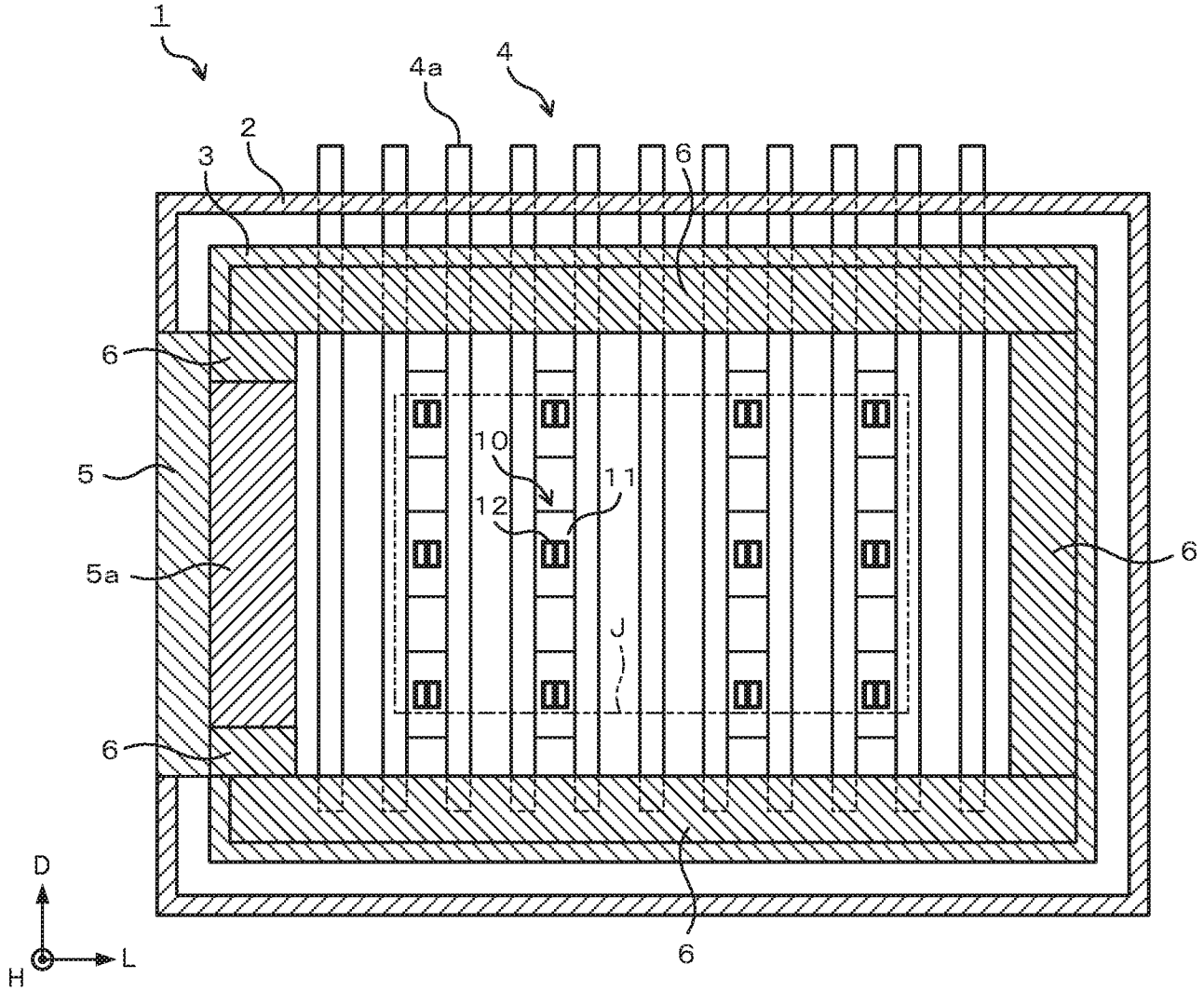
FIG. 2 is a sectional view taken along A-A in FIG. 1.

The heaters 4 are provided above and below the workpiece W in the treatment container 3. A heating element 4*a* of the heater 4 has a shape extending in a horizontal direction (a furnace width direction D in this embodiment) as illustrated in FIG. 2. A tip end portion (an end portion on the lower side in FIG. 2) of the heating element 4*a* is fixed in a manner to be embedded in a heat insulating material 6 in the treatment container 3, and the other end portion thereof penetrates the side wall of the treatment container 3 and the side wall of the vacuum chamber 2 and extends to the outside of the vacuum chamber 2. Further, a plurality of heating elements 4*a* of the heaters 4 are provided at intervals along a furnace length direction L. Note that the shape of the heating element 4*a* is not limited to that described in this embodiment.

A plurality of support posts 10 are arranged at intervals along the furnace length direction L, and the plurality of support posts 10 are arranged at intervals also in the furnace width direction D as illustrated in FIG. 2. As illustrated in FIG. 3 to FIG. 6, the support post 10 includes a base 11, a pillar part 12 composed of a pillar member attached to the base 11, and two columnar-shaped round bars 13 in contact with the jig J at the upper end of the pillar part 12. A bottom surface of the base 11 corresponding to the bottom surface of the support post 10 is in contact with the heat insulating material 6 provided at the bottom part in the treatment container 3, and each support post 10 is arranged so that the pillar part 12 is located between the heating elements 4*a* of the heater 4. The side surfaces of the pillar part 12 of each support post 10 face the heating elements 4*a* of the heater 4.

Figure 6:
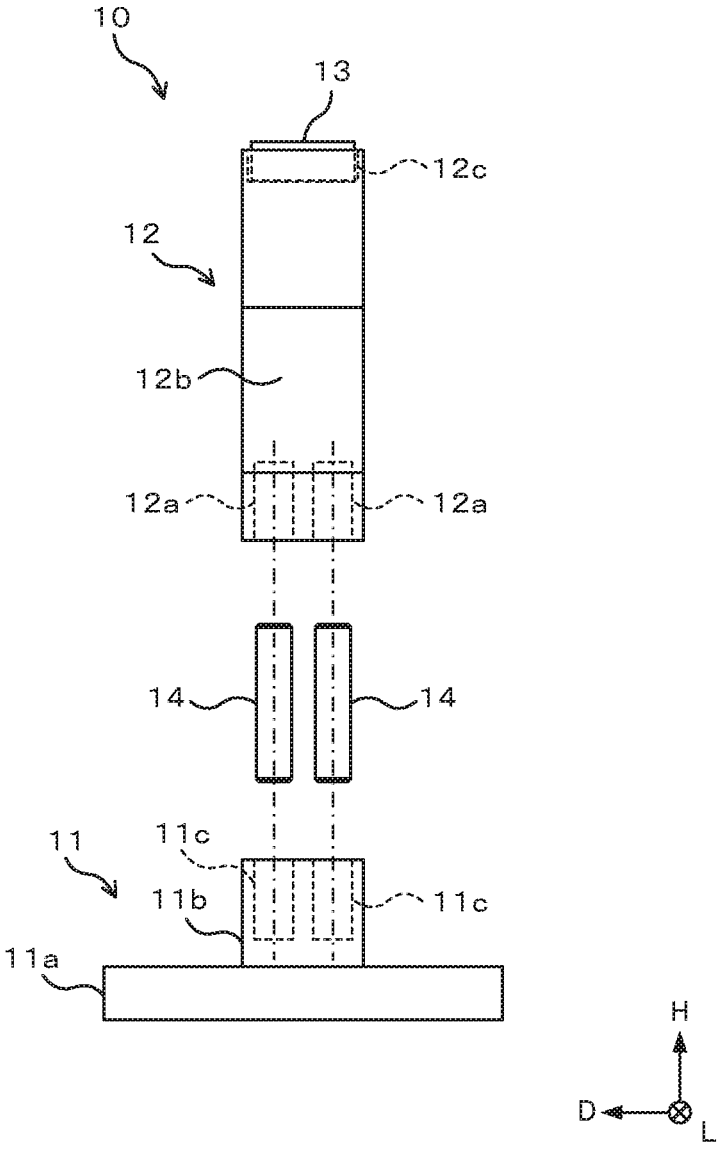
FIG. 6 is an exploded view of the support post according to the embodiment of the present invention.

The base 11 in this embodiment is composed of a square flat plate member 11*a* in contact with the heat insulating material 6 of the treatment container 3, and a square member 11*b* having longitudinal and lateral dimensions in a plan view small relative to the flat plate member 11*a* and welded to the top of the flat plate member 11*a*. As illustrated in FIG. 6, the square member 11*b* has recesses 11*c* formed in a manner to bore an upper surface portion. The recesses 11*c* are formed into a columnar shape having a long side direction in a furnace height direction H, and provided at two places along the furnace width direction D.

Figure 3:
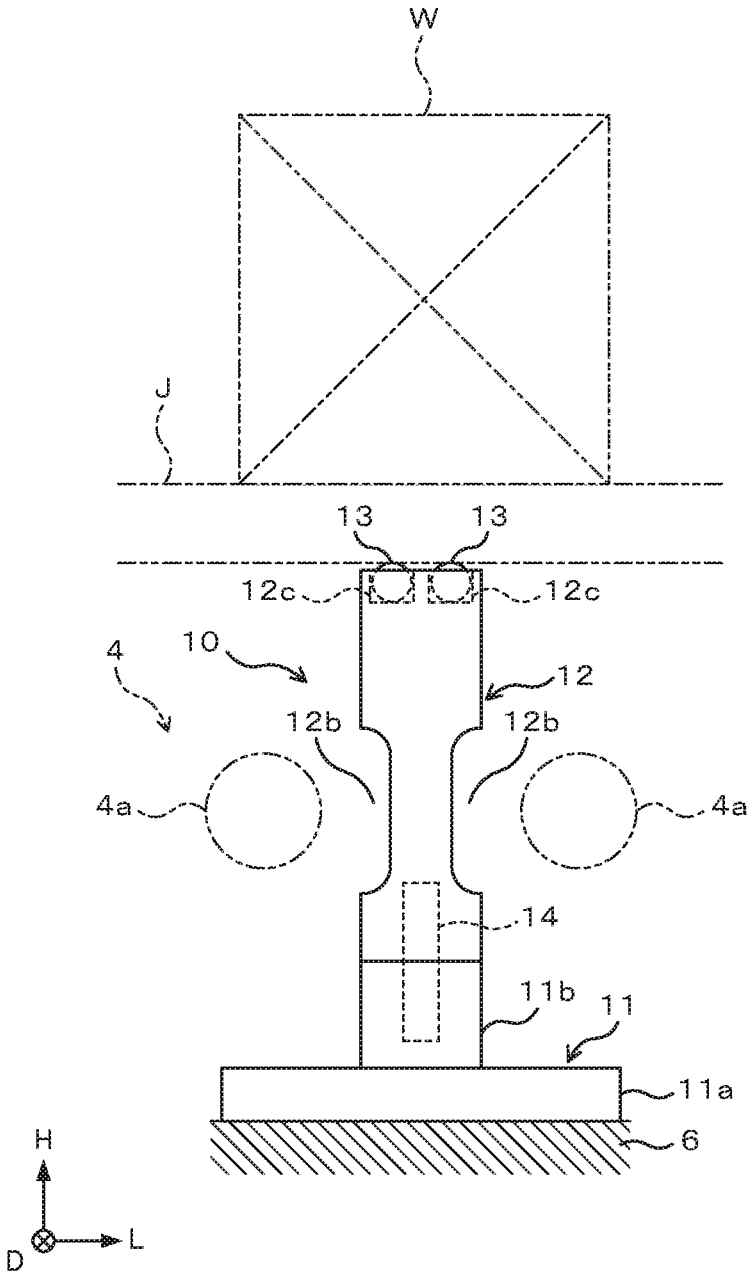
FIG. 3 is a side view illustrating a schematic configuration of a support post according to the embodiment of the present invention.
Figure 4:
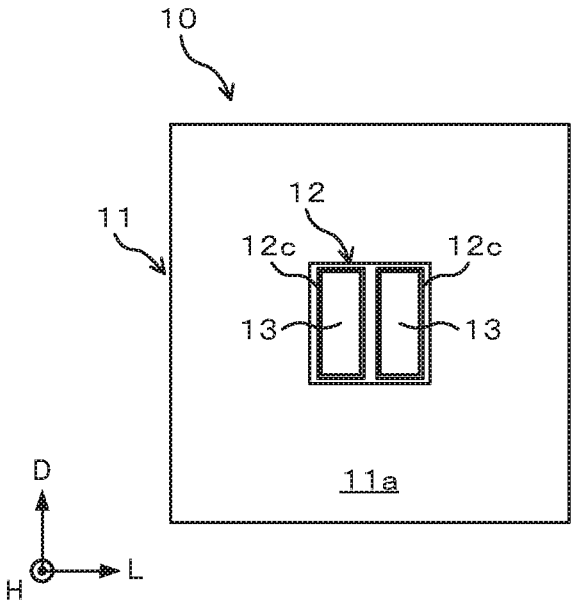
FIG. 4 is a plan view illustrating the schematic configuration of the support post according to the embodiment of the present invention.
Figure 5:
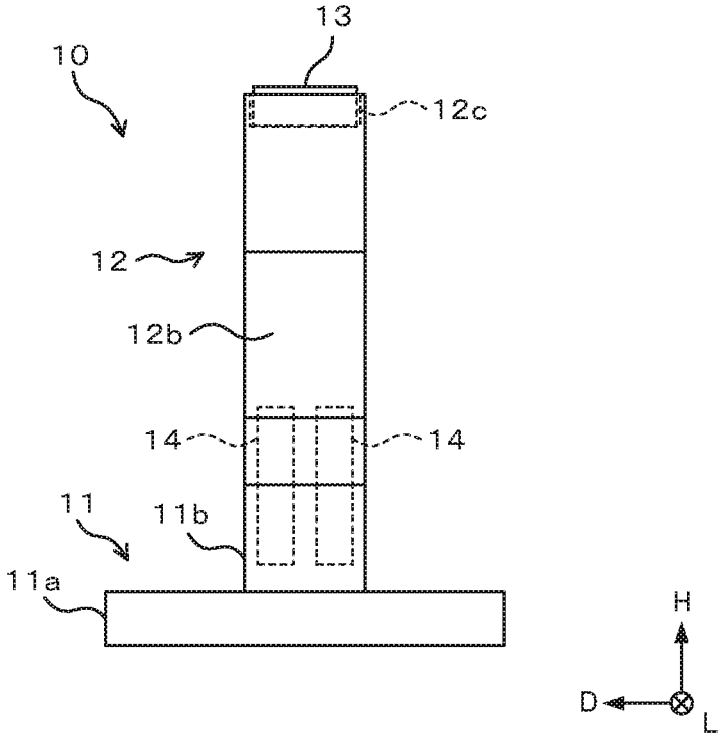
FIG. 5 is a front view illustrating the schematic configuration of the support post according to the embodiment of the present invention.

The pillar part 12 is in the same shape as that of the square member 11*b* of the base 11 in a plan view, and formed to extend in the furnace height direction H. As illustrated in FIG. 6, the pillar part 12 has recesses 12*a* formed in a manner to bore a lower surface portion, and the recesses 12*a* are provided at two places along the furnace width direction D as with the recesses 11*c* of the square member lib. Pins 14 are inserted between the recesses 12*a* of the pillar part 12 and the recesses 11*c* of the square member 11*b*, thus fixing the pillar part 12 and the square member 11*b* as illustrated in FIG. 3 to FIG. 5. Since the base 11 and the pillar part 12 in this embodiment are fixed only by the pins 14, the pillar part 12 can be easily removed only by lifting up the pillar part 12. In this embodiment, the pillar part 12 of the support post 10 is located between the heating elements 4*a* of the heater 4 and the heating elements 4*a* are provided in a manner to cover a part of the base 11 as illustrated in FIG. 2. Therefore, if the base 11 and the pillar part 12 of the support post 10 are integrated, the whole support post 10 needs to be taken out by removing the heater 4 once for repairing or changing the pillar part 12. On the other hand, the configuration that the base 11 and the pillar part 12 of the support post 10 can be separated as in this embodiment enables removal of only the pillar part 12 from the base 11, thus making it possible to easily repair or change the pillar part 12.

As illustrated in FIG. 3, the pillar part 12 of this embodiment has narrow parts 12*b* provided at portions facing the heating elements 4*a* of the heater 4 in a manner to bore side surfaces of the pillar part 12. The narrow part 12*b* is formed in a manner to escape from the shape of the heating element 4*a* and therefore can suppress local heating of the pillar part 12 due to adjacency of the pillar part 12 and the heating element 4*a*. With this, the temperature difference in the support post 10 itself can be decreased to further uniformly heat the workpiece W.

The two round bars 13 provided at the upper end of the pillar part 12 are fitted in grooves 12*c* formed at the upper end of the pillar part 12, in the state of being arranged side by side in the furnace length direction L with their long side direction directed in the furnace width direction D. The depth of the groove 12*c* is slightly smaller than the diameter of the round bar 13, so that a part of the round bar 13 fitted in the groove 12*c* is in a state of projecting upward from the upper end of the pillar part 12. The jig J on which the workpiece W is mounted is supported by coming into contact with the round bars 13. In other words, in the support post structure in this embodiment, the jig J comes into contact with the circumferential surface of the round bar 13, and therefore the contact between the jig J and the round bar 13 is a line contact. This can reduce the contact area between the support post 10 and the jig J, thus making it hard for both the members to adhere to each other. Further, the heat quantity transferred by heat conduction via the contact portion between the support post 10 and the jig J decreases, thus enabling further soaking of the workpiece W. Further, since the two round bars 13 come into line contact with the jig J, the jig J can be supported at two places per support post and therefore can more stably support the workpiece W. Furthermore, only when the jig J comes into contact with any one round bar 13 of the two round bars 13, the function for supporting the jig J by the support post 10 provided with the round bar 13 can be sufficiently exhibited, thus eliminating the need to achieve a high transfer position accuracy of a transfer apparatus that mounts the jig J on which the workpiece W is mounted, onto the support post 10. Further, the round bar 13 is structured to be merely fitted in the groove 12*c* of the pillar part 12, so that when a crack or a breakage of the round bar 13 occurs, the round bar 13 can be easily changed. More specifically, it is preferable that a contact member (the round bar 13 in the case of this embodiment) coming into contact with a member to be mounted on the support post 10 (the jig J in the case of this embodiment) is provided to be freely attachable to and detachable from the support post 10. Further, the round bar 13 is preferably provided such that its long side direction is directed in a direction vertical to the long side direction of the rectangular jig J in a plan view as in FIG. 2. Thus, even when the jig J is deformed due to thermal expansion on the long edge side, the jig J can be located inside the round bars 13, and therefore the jig J can be stably supported. Note that the round bar 13 is used as the contact member coming into line contact with the jig J in this embodiment, but the contact member may be another member.

Raw materials of the members constituting the support post 10 are not particularly limited as long as they are heat-resistant steel and, for example, SUS 310S is used. Besides, ceramics such as alumina, mullite, zirconia and other materials with high-temperature strength may be used. In particular, when the contact member such as the round bar 13 coming into contact with the jig J is formed of the ceramics, occurrence of adhesion due to the contact with the jig J can be suppressed. This effect can be obtained even in the case of applying ceramics coating on the surface of the contact member even if the contact member itself is not formed of ceramics. In short, as long as a portion coming into contact with the member (the jig J in the case of this embodiment) mounted on the support post 10 is formed of the ceramics, occurrence of adhesion of both the members can be suppressed. Note that the ceramics have characteristics of being susceptible to thermal shock. Therefore, in the case where the contact area between the member mounted on the support post 10 and the contact member made of the ceramics is large, the heat quantity transferred due to the heat conduction increases, thus possibly causing a crack of the contact member due to rapid cooling by the contact member. Accordingly, when the contact member is formed of the ceramics, the contact member is preferably configured to come into line contact with the member (the jig J in the case of this embodiment) mounted on the support post 10, like the round bar 13 in this embodiment.

The vacuum carburizing furnace 1 according to this embodiment is configured as described above. Note that the number, the shape, and the arrangement positions of the support posts 10 are appropriately changed so that the workpiece W can be stably and directly supported according to the shapes and the like of the workpiece W and the jig J.

In the vacuum carburizing furnace 1 in this embodiment, when the jig J on which the workpiece W is mounted is mounted on the support posts 10, a transfer apparatus (not illustrated) such as a jig transfer fork is used. For example, outside the vacuum chamber 2, the jig J with the workpiece W set thereon is mounted on the jig transfer fork, and the jig transfer fork advances along the furnace length direction L to the inside of the treatment container 3. Then, the jig transfer fork lowers and delivers the jig J from the jig transfer fork to the support post 10, whereby the jig J is supported on the support posts 10. Thereafter, the jig transfer fork retreats along the furnace length direction L toward the outside of the vacuum chamber 2. Note that the shape of the jig J is not limited to the tray shape as in this embodiment, but a jig in a basket shape or a jig in a multistage type on which the workpieces W are mounted on layers may be adopted. Besides, though the explanation is omitted, the vacuum carburizing furnace 1 includes a configuration necessary for performing a vacuum carburizing treatment, such as a gas inlet for supplying a treatment gas into the treatment container 3, an exhaust pipe and a vacuum pump for exhausting the vacuum chamber 2, and so on.

According to the above vacuum carburizing furnace 1 of this embodiment, the support of the workpiece W via the jig J is performed only by the support posts 10, thus making it possible to make the interception of heat radiation of the heater 4 from below the workpiece less than that in the case where the conventional rail-shaped member supports the workpiece W. This can reduce the difference in input heat quantity between the upper surface side and the lower surface side of the workpiece W to decrease the temperature variation in the workpiece W.

Figure 7:
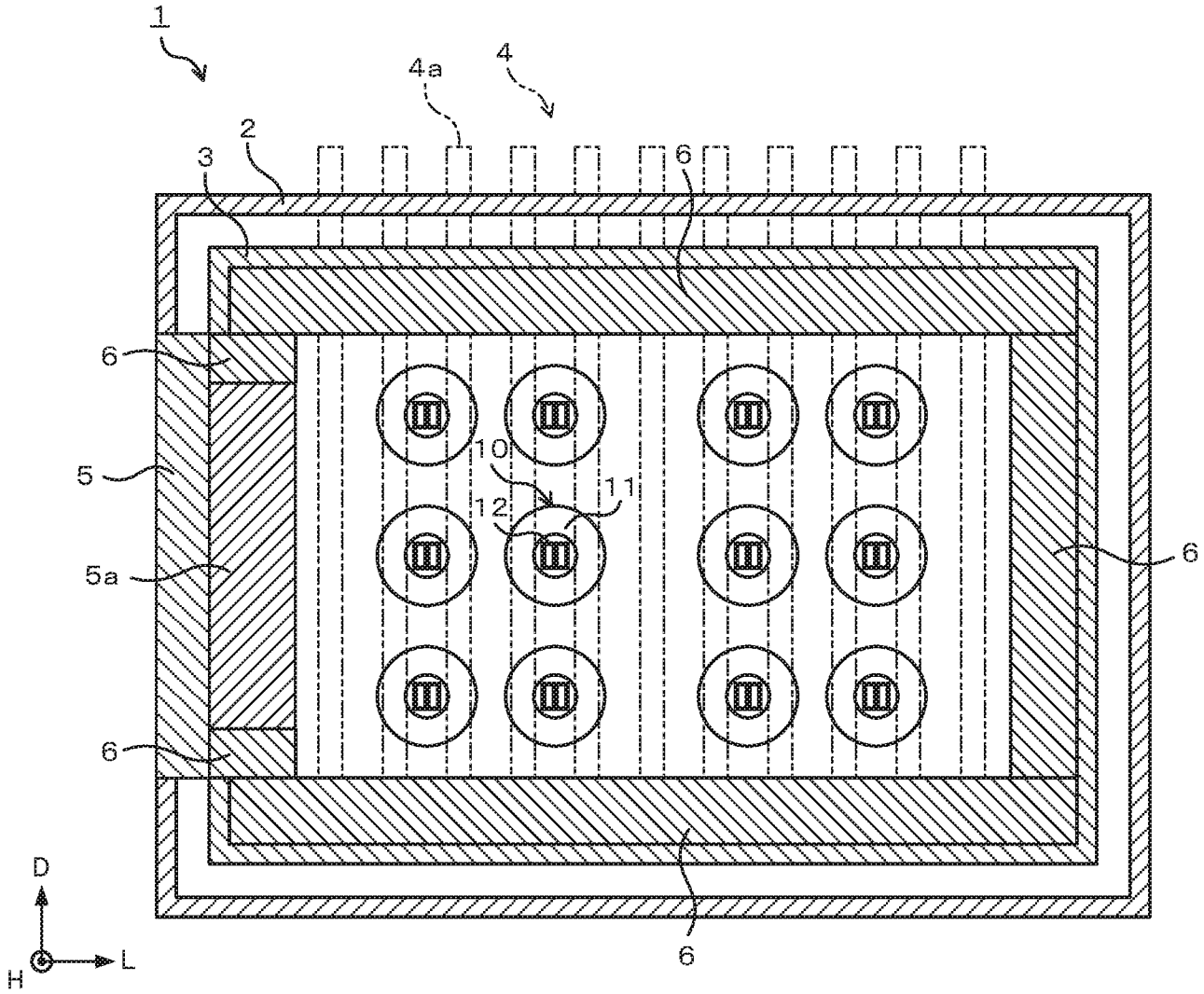
FIG. 7 is a plan view illustrating a schematic shape of a support post according to another embodiment of the present invention.

Note that the support post 10 in this embodiment is configured in a square shape using the pillar part 12 in a prism shape, but the support post 10 may be in another polygonal shape or may be in a circular shape as in FIG. 7. Further, the workpiece W is supported via the jig J in this embodiment, but the workpiece W may be supported by the support posts 10, for example, for the case of a large-size workpiece W. Further, the base 11 of the support post 10 is not limited to the structure composed of the flat plate member 11*a* and the square member 11*b* as in this embodiment. Further, the support post 10 may be configured such that the base 11 and the pillar part 12 are integrated. Additionally, the support post 10 may be configured not to have the narrow part 12*b*. Further, the support post 10 may be configured to come into surface contact with the jig J, for example, without providing the round bar 13. In any case, it is possible to prevent interception of heat radiation of the heater 4 as compared with the conventional rail-shaped support member and therefore suppress the temperature variation in the workpiece W. Note that from the viewpoint of preventing interception of heat radiation of the heater 4, it is premised that the heater 4 is provided at least below the workpiece W in the treatment container 3. In this case, from the viewpoint of the soaking the workpiece W, it is preferable to provide the heater 4 above the workpiece W, but another heater 4 may be provided at another place such as a side or the like of the workpiece W.

Besides, the vacuum carburizing furnace 1 has been described as an example of the heat treatment facility in this embodiment, and the support post structure as in this embodiment is also applicable to a carburizing furnace which performs a carburizing treatment by another method such as gas carburizing, and a nitriding treatment furnace which performs a gas nitriding treatment, a gas nitrocarburizing treatment and the like, other than the vacuum carburizing furnace. In other words, the heat treatment facility requiring the support for the workpiece W becomes possible to heat the workpiece W more uniformly than before by applying the support post structure as in this embodiment.

EXAMPLE

As an example of the present invention, a heating test for the workpiece W on the assumption of the carburizing treatment was carried out using the vacuum carburizing furnace according to the present invention. The vacuum carburizing furnace according to the present invention has the same structure as that of the furnace structure described in the above embodiment illustrated in FIG. 1 and FIG. 2. More specifically, a treatment container is provided in a vacuum chamber, and a plurality of support posts each composed of a base, a pillar part, and round bars are provided inside the treatment container. Further, heaters are provided above and below a workpiece, and a plurality of heating elements of the heaters extend in a furnace width direction and are arranged at intervals in a furnace length direction. Further, the pillar part of the support post is arranged between the heating elements of the heater, and narrow parts are provided at portions, facing the heating elements of the heater, of the pillar part of the support post. Note that as a comparative example, a heating test under the same conditions as those in the example was carried out using a vacuum carburizing furnace configured such that the support post is changed to the conventional rail-shaped support member. The configuration other than the support post of the vacuum carburizing furnace in the comparative example is the same configuration as that of the vacuum carburizing furnace in the example.

The heating test was carried out by heating the workpiece from room temperature up to 950° C. in a state where the pressure in the treatment container was kept at 100 Pa or less. The temperature of the workpiece was measured by embedding a thermocouple at a temperature measurement point. Then, the temperature difference in the workpiece at the time when the temperature at a certain point on the workpiece upper surface (hereinafter, a temperature measurement point on the workpiece upper surface) became 700° C. and the temperature difference in the workpiece at the time when the temperature became 950° C. were measured. Note that the temperature difference in the workpiece is a difference between the temperature at the temperature measurement point on the workpiece upper surface and the temperature measured at a certain point on a workpiece lower surface (hereinafter, a temperature measurement point on the workpiece lower surface), and the temperature measurement point on the workpiece upper surface and the temperature measurement point on the workpiece lower surface are points located at the same position in a plan view, namely, on the same vertical line. The shapes of the workpieces used in the example and the comparative example are the same, and the temperature measurement points on the workpiece upper surface and on the workpiece lower surface are also the same position. Further, the temperature measurement point on the workpiece lower surface in the example is exposed to the heater, whereas the temperature measurement point on the workpiece lower surface in the comparative example is not exposed to the heater because the rail-shaped support member exists.

The result of the above heating tests are listed in following Table 1.

TABLE 1

| | TEMPERATURE DIFFERENCE IN WORKPIECE | |
|---|---|---|
| | AT TIME OF 700° C. | AT TIME OF 950° C. |
| EXAMPLE | 8.4° C. | 0.2° C. |
| COMPARATIVE EXAMPLE | 39.5° C. | 3.2° C. |

Both at the time when the temperature at the temperature measurement point on the workpiece upper surface became 700° C. and at the time when the temperature became 900° C. as listed in Table 1, the temperature difference in the workpiece in the example became smaller than the temperature difference in the workpiece in the comparative example. In other words, use of the support post in place of the rail-shaped support member as the support member for supporting the workpiece makes it possible to uniformly heat the workpiece.

The preferred embodiments of the present invention have been described above, but the present invention is not limited to the examples. It is obvious that the skilled in the art can arrive at various changed examples and modified examples within the scope of the technical idea described in claims and those should be understood to belong to the technical scope of the present invention.

INDUSTRIAL APPLICABILITY

The present invention is applicable to a vacuum carburizing furnace for a workpiece.

EXPLANATION OF CODES

1 vacuum carburizing furnace
2 vacuum chamber
3 treatment container
4 heater
4*a* heating element of heater
5 door
5*a* door heat insulating material
6 heat insulating material
10 support post
11 base
11*a* flat plate member
11*b* square member
11*c* recess of square member
12 pillar part
12*a* recess of pillar part
12*b* narrow part of pillar part
12*c* groove of pillar part
13 round bar
14 pin
D furnace width direction
H furnace height direction
J jig
L furnace length direction
W workpiece

The invention claimed is:

1. A heat treatment facility performing a heat treatment on a workpiece, the heat treatment facility comprising:

a treatment container in which the workpiece is housed;

a heater which is provided in the treatment container and heats the workpiece by radiation heat at least from below the workpiece; and a plurality of support posts which are provided in the treatment container and support the workpiece, wherein a pillar part of at least one support post of the support posts includes a narrow part at a portion facing a heating element of the heater such that the narrow part and the heating element overlap so that an imaginary line perpendicular to an axial direction of the pillar part passes through both the narrow part and the heating element, and the narrow part is a portion of the pillar part that is between a lower end of the pillar part and an upper end of the pillar part and that includes a cross-sectional area that is smaller than that of an outer peripheral shape of all other portions of the pillar part outside of the narrow part.

2. The heat treatment facility according to claim 1, wherein a portion, which comes into contact with a mount to be mounted on the support post, of the support post is formed of ceramics.

3. The heat treatment facility according to claim 1, wherein the support post is configured to come into line contact with a mount to be mounted on the support post.

4. The heat treatment facility according to claim 1, wherein the support post is configured to allow a contact structure coming into contact with a mount to be mounted on the support post to be attachable thereto and detachable therefrom.

5. The heat treatment facility according to claim 1, wherein the support post comprises a base and the pillar part detachably attached to the base.

* * * * *